US011291990B2

(12) United States Patent
Liu et al.

(10) Patent No.: US 11,291,990 B2
(45) Date of Patent: Apr. 5, 2022

(54) QUASI-VOLUMETRIC SENSING SYSTEM AND METHOD

(71) Applicant: Tai-saw Technology Co., Ltd., Taoyuan (TW)

(72) Inventors: Szu-Heng Liu, Taoyuan (TW); Yi-Qi Huang, Taoyuan (TW); Yu-Tung Huang, Taoyuan (TW)

(73) Assignee: Tai-Saw Technology Co., Ltd., Taoyuan (TW)

( * ) Notice: Subject to any disclaimer, the term of this patent is extended or adjusted under 35 U.S.C. 154(b) by 229 days.

(21) Appl. No.: 16/700,141

(22) Filed: Dec. 2, 2019

(65) Prior Publication Data

US 2020/0206731 A1 Jul. 2, 2020

(30) Foreign Application Priority Data

Dec. 27, 2018 (TW) ..... 107147522

(51) Int. Cl.
*B01L 3/00* (2006.01)

(52) U.S. Cl.
CPC ..... *B01L 3/502* (2013.01); *B01L 2300/06* (2013.01); *B01L 2300/0627* (2013.01);
(Continued)

(58) Field of Classification Search
CPC ..... B01L 2200/0668; B01L 2300/06; B01L 2300/0627; B01L 2300/0636;
(Continued)

(56) References Cited

U.S. PATENT DOCUMENTS

2014/0287423 A1* 9/2014 Nurse ..... B01L 3/502707 435/6.12

FOREIGN PATENT DOCUMENTS

WO 2013/063230 A1 5/2013

OTHER PUBLICATIONS

Njobuenwu, Derrick O. et al., paper entitled "Determination of Contact Angle from Contact Area of Liquid Droplet Spreading on Solid Substrate", Leonardo Electronic Journal of Practices and Technologies, Issue 10, Jan.-Jun. 2007, 10 pages.
(Continued)

*Primary Examiner* — Jennifer Wecker
*Assistant Examiner* — Kathryn Elizabeth Limbaugh
(74) *Attorney, Agent, or Firm* — Bever, Hoffman & Harms, LLP

(57) ABSTRACT

The invention discloses a quasi-volumetric sensing system and method. Plural short-range order (SRO) units are configured on the carrier of a quasi-volumetric device, and arranged as an array, i.e. a long-range order (LRO) unit. Protrusions, configured on the SRO units, can modify the wettability of the carrier to control the liquid volume retained thereon so that the precise volume of the liquid sample or droplets are calculated. Based on the applied force on the LRO unit and the gradient of hydrophilicity-hydrophobicity on the surface, the redundant volume of the liquid sample is removed. Macromolecules, e.g. antibodies, complements, receptor proteins, aptamers, oligosaccharides or oligonucleotides, configured on the protrusions are coupled to specific molecules in the liquid sample or droplets so as to determine characteristics of the specific molecules. Therefore, the open chip device of the invention can be used to achieve the quasi-volumetric measurement and the analysis of specific molecules.

16 Claims, 12 Drawing Sheets

(52) U.S. Cl.
CPC ..... *B01L 2300/0816* (2013.01); *B01L 2300/0819* (2013.01); *B01L 2300/165* (2013.01); *B01L 2400/0433* (2013.01)

(58) Field of Classification Search
CPC ..... B01L 2300/0816; B01L 2300/0819; B01L 2300/0851; B01L 2300/165; B01L 2400/0433; B01L 2400/0436; B01L 2400/086; B01L 3/502; B01L 3/502761
See application file for complete search history.

(56) References Cited

OTHER PUBLICATIONS

Sommers, Andrew et al., paper entitled "Calculating the Volume of Water Droplets on Topographically-Modified, Micro-Grooved Aluminum Surfaces", Purdue University, 2008 Int'l. Refrigeration and Air Conditioning Conference, 9 pages.

* cited by examiner

QUASI-VOLUMETRIC SENSING SYSTEM AND METHOD

CROSS-REFERENCE TO RELATED APPLICATION AND CLAIM OF PRIORITY

This application claims the benefit of Taiwan Patent Application No. 107147522, filed on Dec. 27, 2018, at the Taiwan Intellectual Property Office, the disclosures of which are incorporated herein in their entirety by reference.

FIELD OF THE INVENTION

The present invention is related to a sensing system and method, and in particular, a quasi-volumetric sensing system and method.

BACKGROUND OF THE INVENTION

At present, there are products and services provided by incorporating biochemical reactions with micro-analysis with the micro-electromechanical (MEM) system, wherein trace amount of reagents and samples are used, and the signals differentiated from background signals are obtained using the specificity and sensitivity of specific molecules in the sample. Furthermore, parameters, e.g. the sample volume, and the level of specific molecules in the sample are finally obtained by detecting signals via optical and electromagnetic methods in the MEM system. These parameters are further provided to users or medical professionals.

Most of the current chips are designed to have a reaction zone with a sealed cavity so that the reaction volume is fixed. However, this reaction zone will cause a problem with the washing step which makes it difficult to remove the signals of non-reactive molecules during the biochemical reaction process. Therefore, this chip can only be used in an uncomplicated single-step reaction. If multi-step reactions are desired to be performed with this chip, precisely quantifying tools are essential, which limits the efficacy and usage diversity of the chip.

It is therefore the Applicant's attempt to deal with the above situation encountered in the prior art.

SUMMARY OF THE INVENTION

To overcome problems in the prior art, the present invention provides a chip, device or system having a microstructure surface. The reaction fluid is distributed on the chip without essentially configuring channels or covering a lid to let the channels become the seal channels. The photolithography process technique is used in the present invention, short-range order (SRO) units with different specifications and long-range order (LRO) order are designed, and thus the purpose of adjusting the volume of the reaction fluid is achieved. That is to say, the reaction fluid in the present invention still can be distributed on the chip having seal channels or the opened surfaces. For instance, the reaction fluid fills the seal channels and then is removed therefrom or the fixed volume of the reaction fluid flows through the channels, the SRO units within the channels also can be used to retain the fluid with a specific volume. In addition, macromolecules, e.g. antibodies, complements, receptor proteins, aptamers, oligosaccharides and oligonucleotides, are attached to the microstructures to couple to specific molecules in the reaction fluid so as to measure data of the specific molecules. In the present invention, it is only needed to use trace amounts of reagents, samples or reaction fluids (analytes) in the applications, such as a biosensor, biochip or high-throughput screen platform.

Thus, the present invention discloses a device for quantifying a volume to be reacted in a liquid sample, including a carrier, a plurality of signal detection units and a processor. The carrier includes a surface and a plurality of SRO units disposed on the surface, wherein each of the plurality of SRO units includes a first area and a plurality of protrusions distributed on the first area, at least one of the plurality of protrusions is configured to contact a droplet having a specific volume and a first parameter, and the droplet originates from the liquid sample. Each of the plurality of signal detection units is configured to detect the respective first parameter. In addition, the processor is coupled to the plurality of signal detection units and configured to calculate the volume to be reacted according to the first parameter and a formula (I) as follows:

$$V = \sum_{i=1}^{n} Vi(\theta, a), \tag{I}$$

where V is the volume to be reacted, Vi is the specific volume, θ is a contact angle formed between the droplet and the surface, a is an area within the first area, and n is the number of the plurality of SRO units.

In some embodiments, there is a hydrophobic surface between any adjacent two of the SRO units within the surface. In some embodiments, the plurality of SRO units are arranged to form an array on the surface, the array is an LRO unit having a first and a second ends to form a path between the first and the second ends, and the path represents a gradient of hydrophilicity. In some embodiments, the droplet on the carrier is driven by a force, and moves from the first end to the second end so as to remove a redundant liquid from the droplet.

In some embodiments, the device further includes an inlet and an outlet, and the inlet and the outlet are configured at the same end or at two different ends of the carrier. In some embodiments, the device further includes a plurality of first specific molecules having a first part thereof being configured on the plurality of protrusions, wherein the droplet includes a plurality of second molecules, to and with which the plurality of first molecules are respectively specific and coupled.

In some embodiments, each of the plurality of signal detection units is further configured to detect signals generated when the plurality of first molecules are coupled with the plurality of second molecules. In some embodiments, the processor is further configured to calculate a second parameter of the plurality of second molecules in the liquid sample according to the signals, and the second parameter is at least one selected from the group consisting of the concentration of the second molecules, the number of the second molecules and the viscosity of the droplet. In some embodiments, the plurality of first molecules have a second part thereof configured on the surface.

The present invention further discloses a method for quantifying a volume to be reacted in a liquid sample by a chip, wherein the chip includes a carrier, a plurality of SRO units on the carrier, and a plurality of signal detection units electrically connected to each of the plurality of SRO units, and each of the plurality of SRO units includes a plurality of protrusions being distributed thereon. The method includes: providing the liquid sample; applying the liquid sample on the carrier to enable at least one of the plurality of protrusions to contact a droplet having a specific volume and a first parameter, wherein the droplet originates from the liquid sample; detecting the first parameter with a respective one of the plurality of signal detection units; and calculating the volume to be reacted according to the first parameter a formula (I) as follows:

$$V = \sum_{i=1}^{n} Vi(\theta, a), \quad \text{(I)}$$

where V is the volume to be reacted, Vi is the specific volume, θ is a contact angle formed between the droplet and the surface, a is an area within the first area, and n is the number of the plurality of SRO units.

In some embodiments, there is a hydrophobic surface between any adjacent two of the SRO units within the surface, the plurality of SRO units are arranged to form an array on the surface, the array is an LRO unit having a first and a second ends to form a path between the first and the second ends, and the path represents a gradient of hydrophilicity.

In some embodiments, the method further includes: applying a force on the droplet to enable the droplet to move from the first to the second ends so as to remove a redundant liquid from the droplet. In some embodiments, the force is one selected from the group consisting of mechanical force, electromagnetic force, capillary force, hydrophilicity, hydrophobicity and the combination thereof. The mechanical force is one of gravity and waves generated from the piezoelectric effect.

The present invention further discloses a quasi-volumetric sensing system for a liquid sample which includes: a carrier including a surface; and a plurality of SRO units configured on the surface, wherein each of the plurality of SRO units includes a plurality of areas each of which includes a plurality of protrusions, and a distance between any adjacent two protrusions in one area is different from that in another area, wherein the liquid sample is applied to run across the plurality of SRO units to enable at least one droplet from the liquid sample to be retained on at least one of the plurality of protrusions.

In some embodiments, the at least one droplet includes a first parameter and a specific volume, the liquid sample includes a plurality of molecules having a specific concentration, and the quasi-volumetric sensing system further includes: a plurality of signal detection units, each of which is electrically connected to a respective one of the plurality of SRO units to detect the respective first parameter; and a processor coupled to the plurality of signal detection units and configured to calculate the specific concentration according to the first parameter, wherein the sum of all of the specific volumes is a volume to be reacted, the specific volumes are determined by a structure of the plurality of SRO units, and the volume to be reacted is obtained according to a formula (I) as follows:

$$V = \sum_{i=1}^{n} Vi(\theta, a), \quad \text{(I)}$$

where V is the volume to be reacted, Vi is the specific volume, θ is a contact angle formed between the droplet and the surface, a is an area within the first area, and n is the number of the plurality of SRO units.

The present invention further discloses a system for sensing a liquid sample, including: a carrier including a surface; a plurality of SRO units disposed on the surface and including a plurality of areas; a plurality of structures of different heights disposed in each of the plurality of areas, wherein each of the plurality of structures is concavely or convexly formed on the surface; and a plurality of molecules disposed on each of the plurality of structures and configured to sense the liquid sample, wherein the plurality of areas include a first area and a second area, any adjacent two of the plurality of structures in the first area have a first distance, any adjacent two of the plurality of structures in the second area have a second distance, and the first distance is different from the second distance.

In some embodiment, the plurality of structures are configured to increase a surface area of the surface.

The present invention further discloses a quasi-volumetric sensing system for sensing a liquid sample, wherein the liquid sample includes a plurality of molecules having a concentration, and the system includes: a carrier including a surface; a plurality of SRO units disposed on the surface and including a plurality of areas; a plurality of structures of different heights disposed in each of the plurality of areas, wherein each of the plurality of structures is concavely or convexly formed on the surface; a plurality of molecules disposed on each of the plurality of structures and configured to sense the liquid sample, wherein the liquid sample includes a plurality of droplets having a parameter, and each of the droplets is retained by at least one of the plurality of structures; a signal detection device electrically connected to the plurality of SRO units and configured to detect the parameter; and a processor coupled to the signal detection device and configured to calculate the concentration using the parameter.

BRIEF DESCRIPTION OF THE DRAWINGS

The objectives and advantages of the present invention will become more readily apparent to those ordinarily skilled in the art after reviewing the following detailed descriptions and accompanying drawings.

DETAILED DESCRIPTION OF THE PREFERRED EMBODIMENTS

Figure 1A:
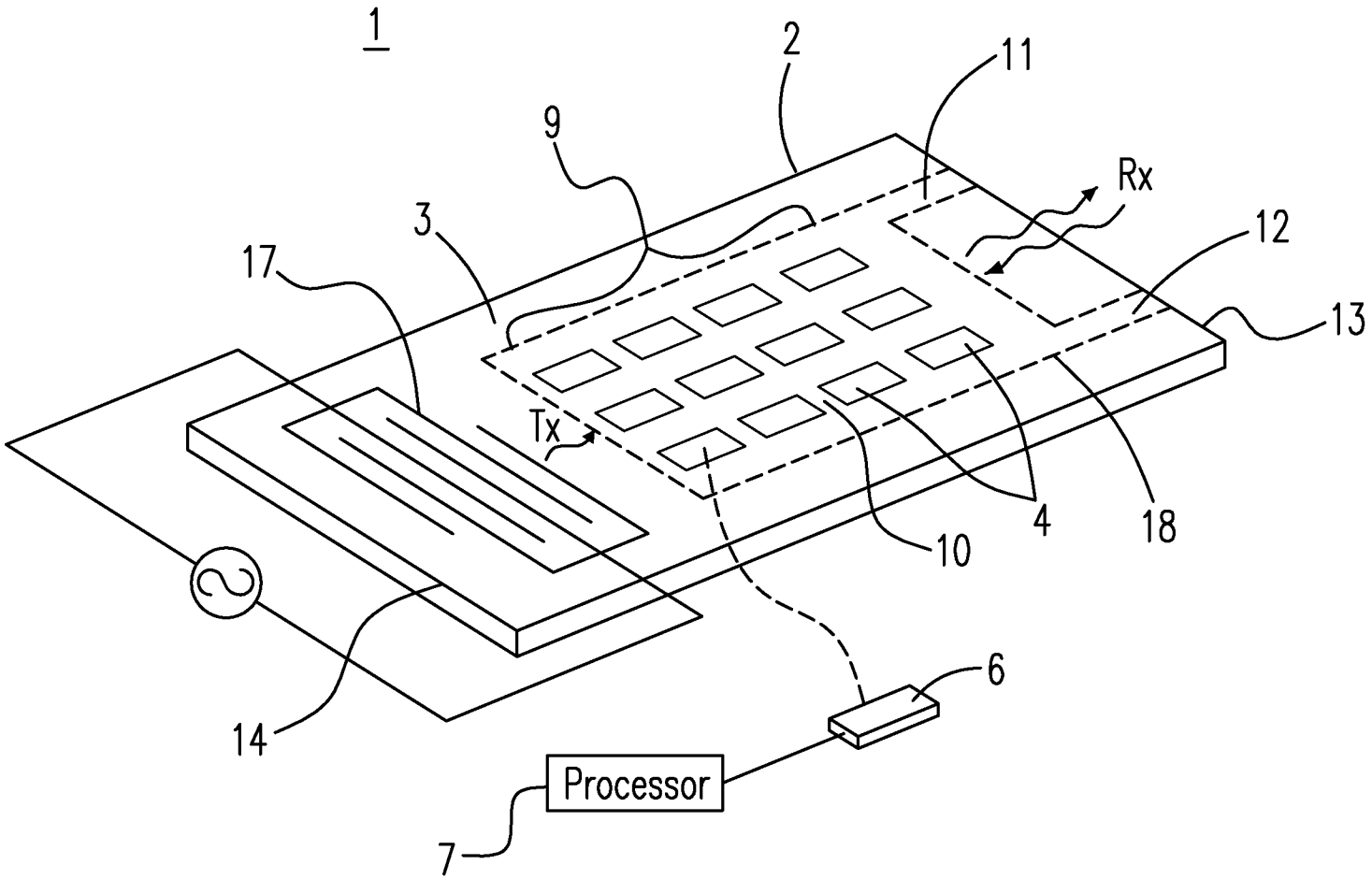
FIG. 1A is a diagram showing a quasi-volumetric device in the embodiment of the present invention.

The present invention will now be described more specifically with reference to the following embodiments. It is to be noted that the following descriptions of the preferred embodiments of this invention are presented herein for purpose of illustration and description only; they are not intended to be exhaustive or to be limited to the precise form disclosed.

In the present invention, the photolithography process technique is used to design the geometrically structural features for SRO units and LRO units on a chip surface so that liquid samples can be carried by the SRO/LRO units on the chip surface. SRO units are reaction units and have microstructures with plural protrusions. The microstructure protrusions are structures which can provide high aspect ratio, and reserve or enlarge enough surface area on the condition that the area of plane is not increased. The changes on the structural and dimensional features of the microstructure protrusions can modify the wettability of the liquid sample on the chip so as to control the volume of the retained liquid sample or droplets on the chip surface. The distance between protrusions is modified via the photolithography process technique so as to control the contact angle of the carried liquid sample or droplet. Furthermore, the specific volume of the droplet can be calculated via the horizontal surface area that plural protrusions are distributed on the surface. The specific volume of the droplet which is calculated by the unit pattern (with the same geometrically structural features) is fixed so as to achieve the quasi-volumetric effect. The quasi-volumetric method of the present invention can be performed on the opened surface of the quasi-volumetric chip, device or sensing system. The design of a cavity or a sealed channel is not essential.

The plural SRO units of the present invention can be arranged as an array on the chip surface to form a LRO unit. The array can be a regular array, including but not limited to a triangle array, a square array, a rectangular array, a polygonal array and a circular array, or an irregular array. In addition to the area for the SRO units and the LRO unit, the chip surface can be designed as a hydrophobic surface. Thus, after a liquid sample or droplets move on the chip surface, only the SRO units and/or the LRO unit can retain the liquid sample or droplets. The driving force to control the movement of the liquid sample or droplets on the chip surface includes, but is not limited to, mechanic force (gravity or waves generated by piezoelectric effect), electromagnetic force, capillary force, hydrophilicity and/or hydrophobicity. When the intensity of the driving force is adjusted to be smaller than the wettability and adsorption of the SRO units, the redundant liquid sample will be removed. However, the retention of the liquid sample or droplets on the SRO units is not affected.

Because the chip of the present invention is an open chip and does not have any cavity or specific channel, multi-step reactions can be performed on the chip compared to conventional techniques. Furthermore, reactant or washing agent can be used to remove the redundant liquid sample or droplets and interfering molecules by applying driving force, so that the measured signals are more real and precise. In addition, the open chip of the present invention can be repeatedly used to measure the same or other liquid sample after washing.

Please refer to FIG. 1A, which is a diagram showing a quasi-volumetric device in the embodiment of the present invention. In FIG. 1A, reaction zone 18 and plural SRO units within the reaction zone 18 are configured on the surface 3 of the carrier 2 of the quasi-volumetric device 1, each SRO unit has a specific area on the surface 3, and plural protrusions are distributed on the specific area. The plural protrusions 5 of the SRO unit 4 are arranged in some specific patterns, such as arrays in particular. As shown in FIGS. 2A, 2B, 2C and 2D, plural arrays of protrusions 5 are intensively arranged in the outer region in the SRO unit 4, and other plural arrays of protrusions 5 (i.e. a protrusion 5 matrix) are less intensively arranged in the inner region. It is well known by those skilled in the art that plural sparse-to-dense or dense-to-sparse protrusion areas can be disposed in the SRO units of FIGS. 2A to 2D by way of the inside out or the outside in. Alternatively, different densities of the protrusion disposition in the SRO units can be arranged according to one direction to show a gradient, without arranging by way of inner and outer regions. Furthermore, the protrusions can be various three-dimensional shapes, and include but are not limited to, cylindrical, tetragonal prism, triangular prism or the combination thereof. The top views shown in FIGS. 2A to 2D represent the protrusions 5 with round, square and triangular shapes.

Figure 3:
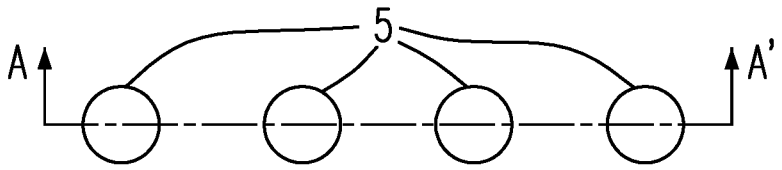
FIG. 3 is a top view showing the plural protrusions in the embodiment of the present invention.
Figure 4:
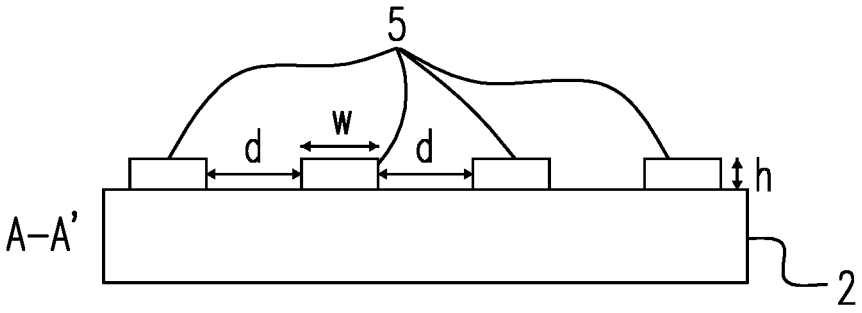
FIG. 4 is a side view showing the plural protrusions in the embodiment of the present invention.

Please refer to FIGS. 3 and 4, which respectively are a top view and a side view showing the plural protrusions in the embodiment of the present invention. The view from the A-A' axis in FIG. 3 is the side view of FIG. 4. The width and height of each protrusion 5 on the carrier 2 are w and h, respectively, and the distance between adjacent two protrusions 5 is d. The distance between two protrusions 5 varies with different densities of areas. The SRO units are formed by surrounding the inner protrusion area with the outer protrusion area. Taking Table 1 as an example, plural protrusion zones of the SRO units are configured as zones 1, 2, 3, 4, 5 and 6 from outside to inside, wherein the distance between protrusions in zone 1 is narrowest, and that in zone 6 is widest so as to form an "outside-dense and inside-sparse" SRO unit. Alternatively, when an "outside-sparse and inside-dense" SRO unit is formed, the distance between protrusions in the middle protrusion zone is narrowest, and that in the most external protrusion zone is widest. The number of protrusion zones in the SRO unit can be increased or decreased on demand without being limited by the embodiment of the present invention.

TABLE 1

| Parameters of protrusions in the plural protrusion areas on the SRO unit | | | | | | |
|---|---|---|---|---|---|---|
| Parameter | Zone 1 | Zone 2 | Zone 3 | Zone 4 | Zone 5 | Zone 6 |
| Width of protrusion (w, μm) | 10 | 10 | 10 | 10 | 10 | 10 |
| Distance between protrusions (d, μm) | 2 | 5 | 10 | 20 | 50 | 80 |
| Height of protrusion (h, μm) | 1.5 | 1.5 | 1.5 | 1.5 | 1.5 | 1.5 |

Please continue referring to FIG. 1A. The signal detection unit 6 is disposed beneath the carrier 2 of the quasi-volumetric device 1, and coupled to the carrier 2 to detect parameters of the droplets. The signal detection unit 6 can be separated from the carrier 2, and both can coupled together when detection is ready. The coupling relationship between the signal detection unit 6 and the carrier 2 can be physically or non-physically connected. The signal detection unit 6 further is coupled to a processor 7, which runs data processing. On a more economic level, the signal detection unit 6 and the processor 6 are integrated as one device which is separated with each other when detection is not yet performed. The integrated device can be used to detect plural quasi-volumetric devices so as to save costs for configuring the signal detection unit 6 and the processor 1 in each quasi-volumetric device 1. The position at which the signal detection unit 6 is situated is not limited to be beneath the carrier 2. The top or the lateral side of the carrier 2 also can be the position for disposing the signal detection device 6.

Figure 5:
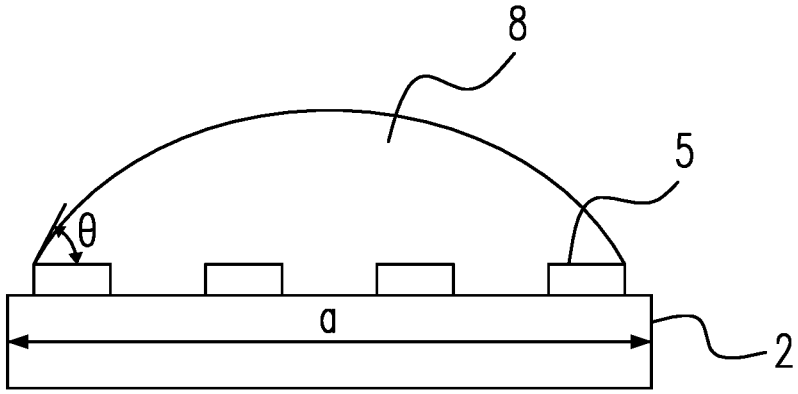
FIG. 5 is a diagram showing that a droplet is carried by the protrusions in the embodiment of the present invention.

Please refer to FIG. 5, which is a diagram showing that a droplet is carried by the protrusions in the embodiment of the present invention. In FIG. 5, a liquid sample is applied on the carrier 2 to enable a droplet 8 in the liquid sample to be attached or retained on the carrier 2. A contact angle θ is formed between the droplet 8 and the surface of the protrusion 5, and the area that the droplet occupies on the SRO unit 4 is symbol "a". The signal detection unit 6 detects the parameters of the droplet 8, and the processor 7 calculates the volume to be reacted by summing up the specific volumes of the droplets according to the parameters of the droplet 8 and formula (I):

$$V = \sum_{i=1}^{n} Vi(\theta, a), \tag{I}$$

where V is the volume to be reacted, Vi is the specific volume, θ is a contact angle formed between the droplet and the surface, a is an area within the first area, and n is the number of the plurality of SRO units.

The specific volume of the droplet also can be referred to parameters in Derrick et al. (Determination of contact angle from contact area of liquid droplet spreading on solid substrate, Leonardo Electronic Journal of Practices and Technologies, 2007, 6(10): 29-38) or other equations, wherein the contact radius of the droplet is R(t), the height of the droplet is $h(t)=\frac{1}{2} R(t)\theta$, the area that the droplet contacts the plane is $a=\frac{1}{2}\pi R(t)$, the volume of the droplet is $V=\frac{1}{2} \pi h(t)R(t)^2$, and t is time.

Please continuously refer to FIG. 1A, the plural SRO units 4 on the carrier 2 are arranged as an array which forms an LRO unit 9, and the surface between plural SRO units is designed as a hydrophobic surface, or is formed as the hydrophobic surface by applying materials thereon. The path from one end to another (the corresponding) end of the carrier 2 forms a gradient of hydrophilicity. In FIG. 1A, a first end 13 and a second end 14 are configured on the carrier 2, and the path of the LRO unit forms the gradient of hydrophilicity from the first end 13 to the second end 14. A droplet 8 on the carrier is subjected to the driving force to move from the first end 13 (with weak hydrophilicity) to the second end 14 (with strong hydrophilicity) via the hydrophobic surface 10, so as to remove the redundant volume in the droplet. The droplet remaining on the particular SRO units refers to stronger hydrophilicity.

In the present invention, the liquid sample can be directly applied on the carrier 2, or the carrier 2 can be directly merged into a container which includes the liquid sample so that the liquid sample or the droplet 8 may attach on the carrier 2. In the scheme that the carrier is directly merged into the container, the carrier is merged and then picked up so that the liquid sample or droplets attach on the carrier. The operator can directly merge the carrier into a container including another liquid sample, or merge the carrier into a container including the washing solution (such as water, phosphate buffered saline, and so on) or a container including an antibody or reactant solution. The number or sequence of the containers and the contained solutions can be modified depending on the operator's demand. Alternatively, inlet 11 and outlet 12 can be configured on the carrier (as shown in FIG. 1A), the liquid sample enters onto the surface 3 via the inlet 11 using a liquid dispensing device, and the redundant liquid sample or droplets leave from the carrier 2 via the outlet 12. The inlet 11 and the outlet 12 can be configured on the same side of the carrier 2. As shown in FIG. 1A, inlet 11 and outlet 12 are configured at the first end 13 of the carrier 2. Inlet 11 and outlet 12 also can be configured at the different ends of the carrier 2 by the skilled person in the art. For instance, inlet 11 is configured at the first end 13, and outlet 12 is configured at the second end 14.

A surface acoustic wave (SAW) element 17 also can be configured on the carrier 2 of the quasi-volumetric device 1 in FIG. 1A, wherein the SAW element 17 was driven by currents to send a transmission signal Tx to pass through droplets on the SRO units 4 so as to generate a reception signal Rx which is further detected by the signal detection unit 6. The processor 7 analyzes specific molecules in the liquid sample or droplets.

Figure 1B:
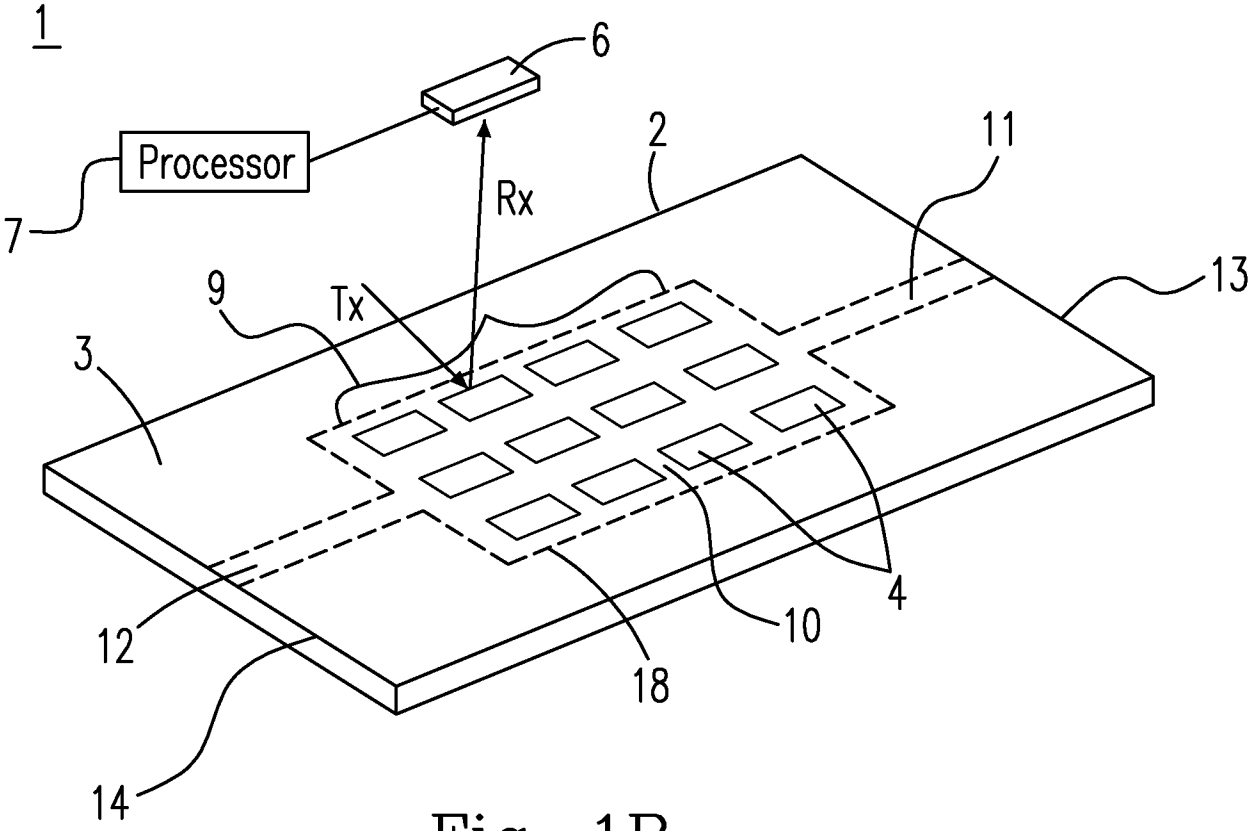
FIG. 1B is a diagram showing another quasi-volumetric device in the embodiment of the present invention.
Figure 2A:
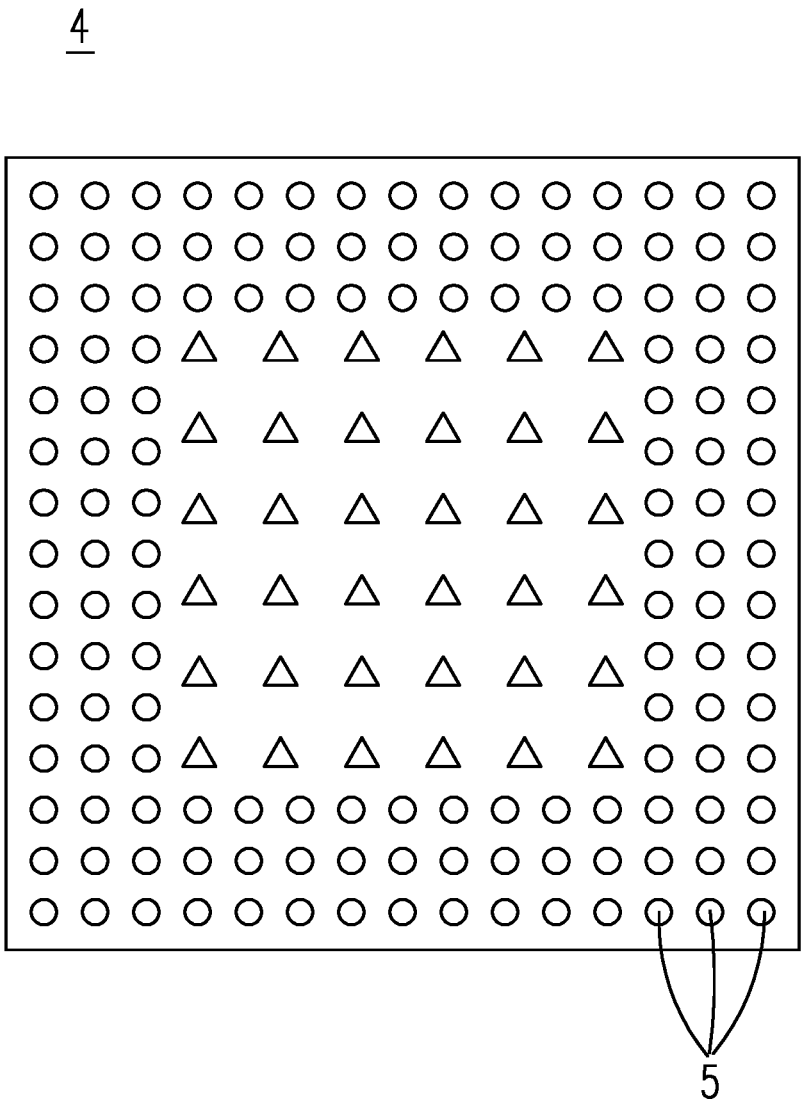
FIG. 2A is a diagram showing that plural protrusions are collected to form a short-range order (SRO) unit in the embodiment of the present invention.
Figure 2B:
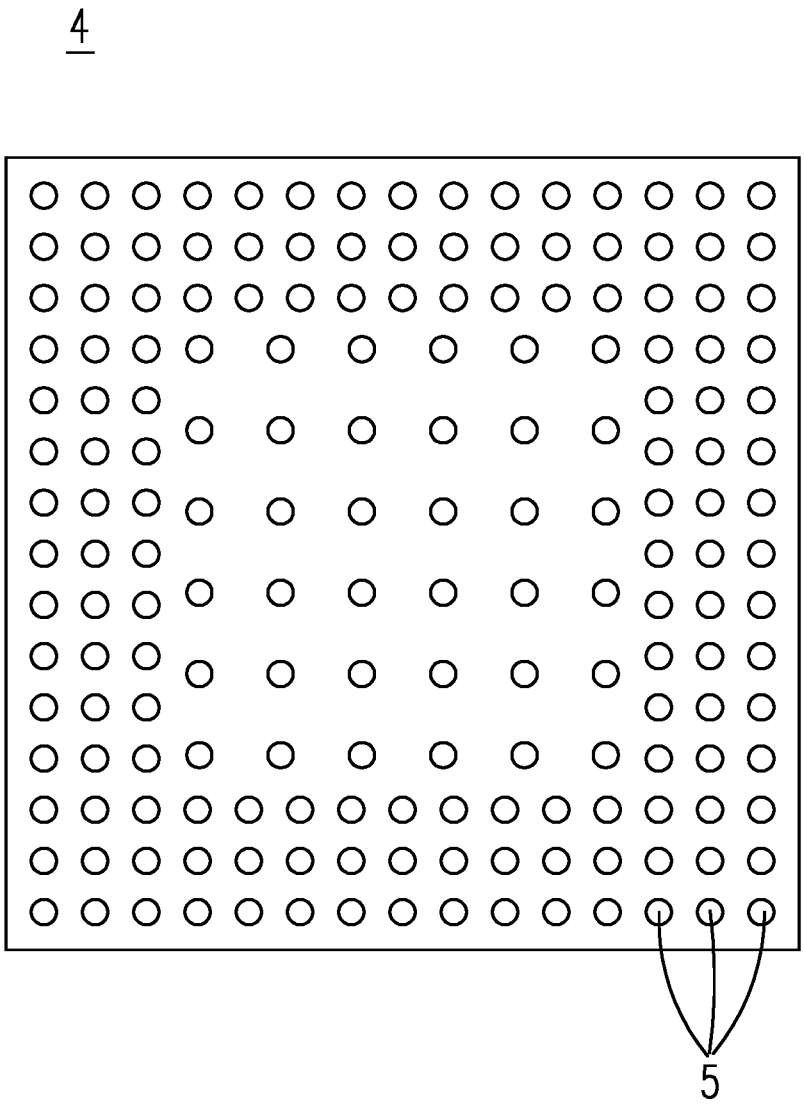
FIG. 2B is a diagram showing that plural protrusions are collected to form an SRO unit in the embodiment of the present invention.
Figure 2C:
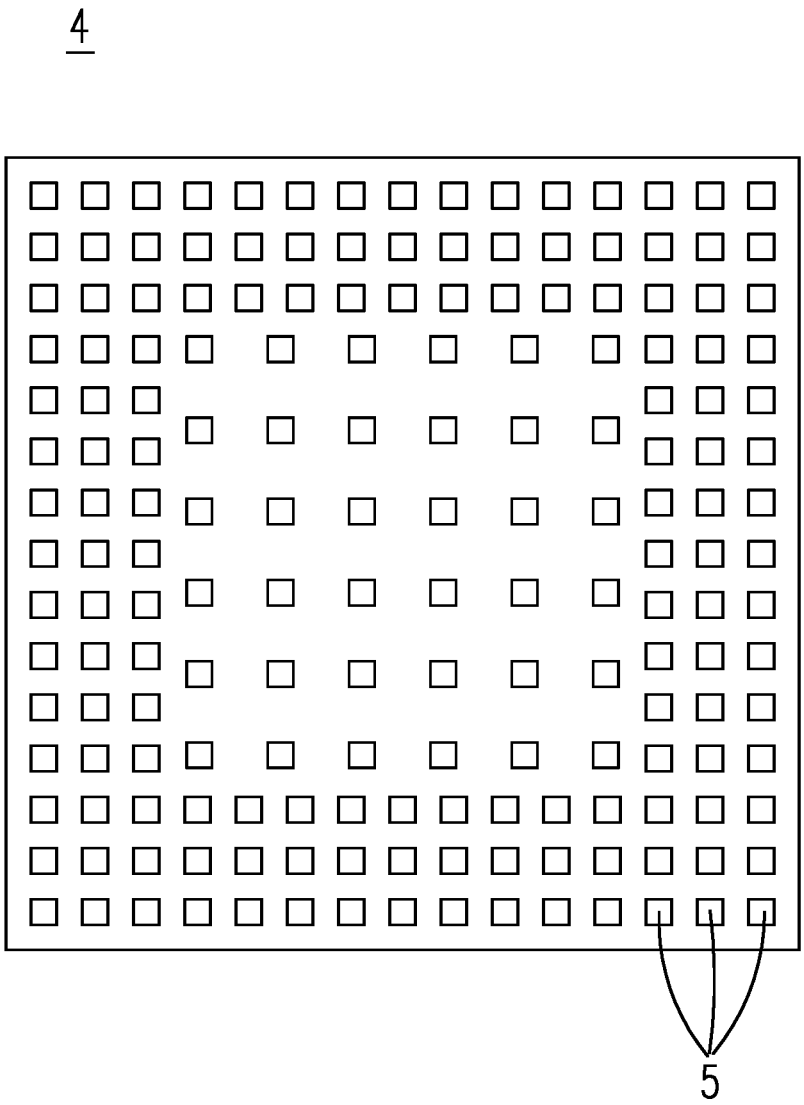
FIG. 2C is a diagram showing that plural protrusions are collected to form an SRO unit in the embodiment of the present invention.
Figure 2D:
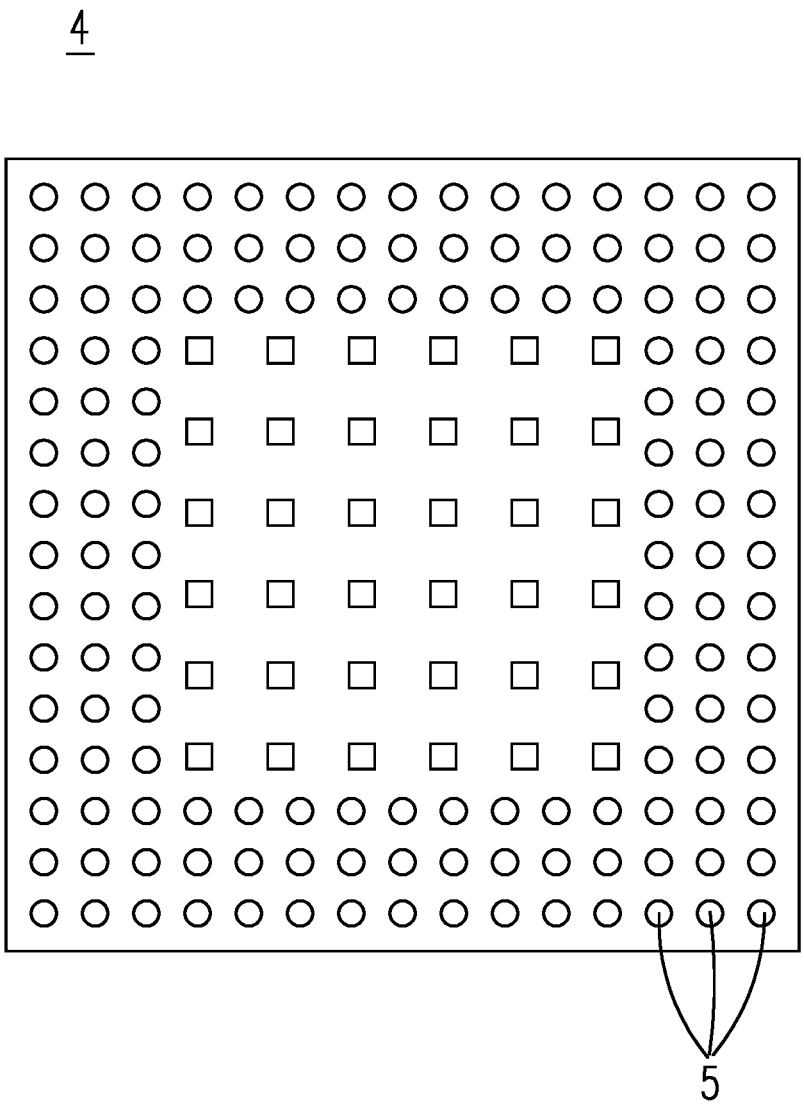
FIG. 2D is a diagram showing that plural protrusions are collected to form an SRO unit in the embodiment of the present invention.

Please refer to FIG. 1B, which is a diagram showing another quasi-volumetric device in the embodiment of the present invention. In FIG. 1B, the sample to be detected or droplets (not shown) enter into the SRO units 4 within the reaction zone 18 via the inlet 11 at the first end 13 of the carrier 2, and finally leave from the outlet 12 at the end 14. The signal detection unit 6 detects the reception signal Rx reflected from the SRO units 4, and the processor 7 performs the analysis on specific molecules of the liquid sample or droplets. In addition to the detection of the reception signal Rx, in some embodiments, the signal detection unit can also detect electrochemical signal.

Therefore, the quasi-volumetric device of the present invention can retain and measure the fixed volume of the droplets by the quasi-volumetric method.

In addition to the quasi-volumetric quantification for the reaction volume, the level or concentration of specific molecules in the liquid sample or droplets is detected.

Figure 6:
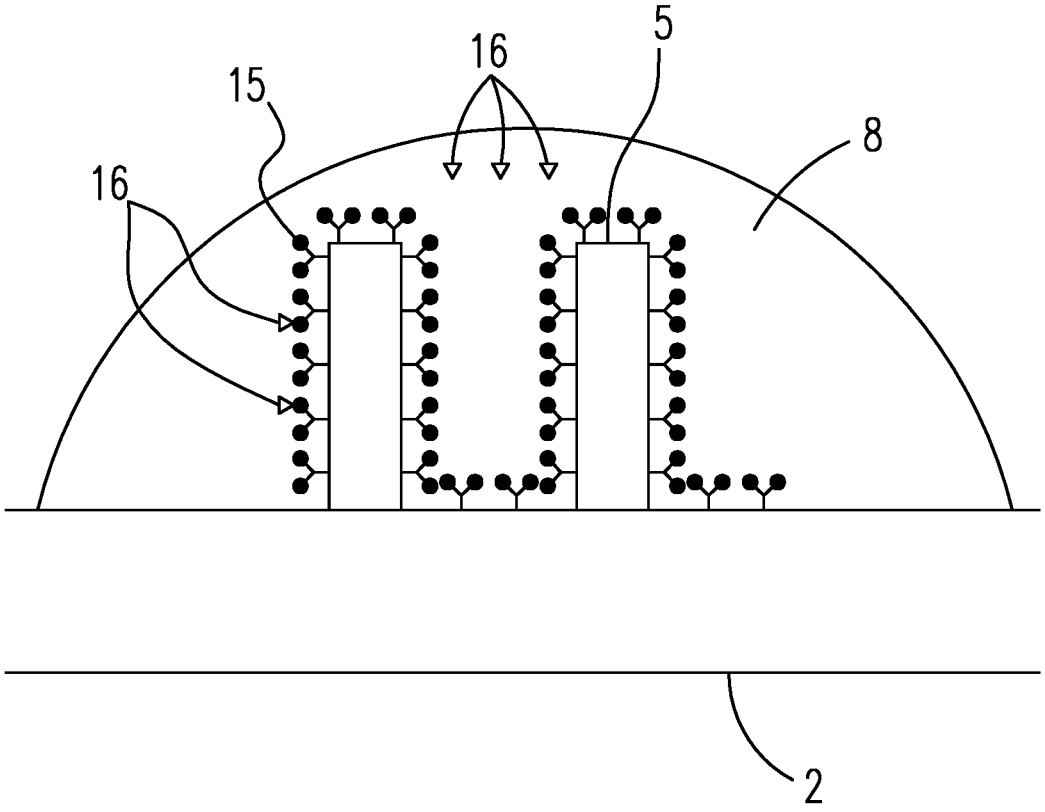
FIG. 6 is a diagram showing that the molecules are coupled on the protrusions in the embodiment of the present invention.

Please refer to FIG. 6, which is a diagram showing that the molecules are coupled on the protrusions in the embodiment of the present invention. In FIG. 6, the first molecules 15 are configured on the protrusions, the second molecules 16 in the droplets 8 are coupled with the first molecules 15 to provide the signal detection unit (not shown in FIG. 6) with signals that the second molecules 16 couple with the first molecules 15. Next, the processor (not shown in FIG. 6) calculates the data such as the concentration, the number, the hydrophilicity and hydrophobicity of the second molecules 16 according to the signal. The first molecules 15 can be macromolecules such as antibodies, complements, receptor proteins, aptamers, oligosaccharides, oligonucleotides and so on, and the second molecules 16 are molecules which can be specifically or partially specific coupled with the first molecules 15. In addition to being configured on the protrusions 5, the first molecules 15 also can be configured on the surface of the carrier 2 to highly use three dimensions. The costs can be decreased when the minimized chips and the microstructure protrusions are manufactured. More first molecules attached on the enlarged surface area could raise the reaction sensitivity.

Figure 7:
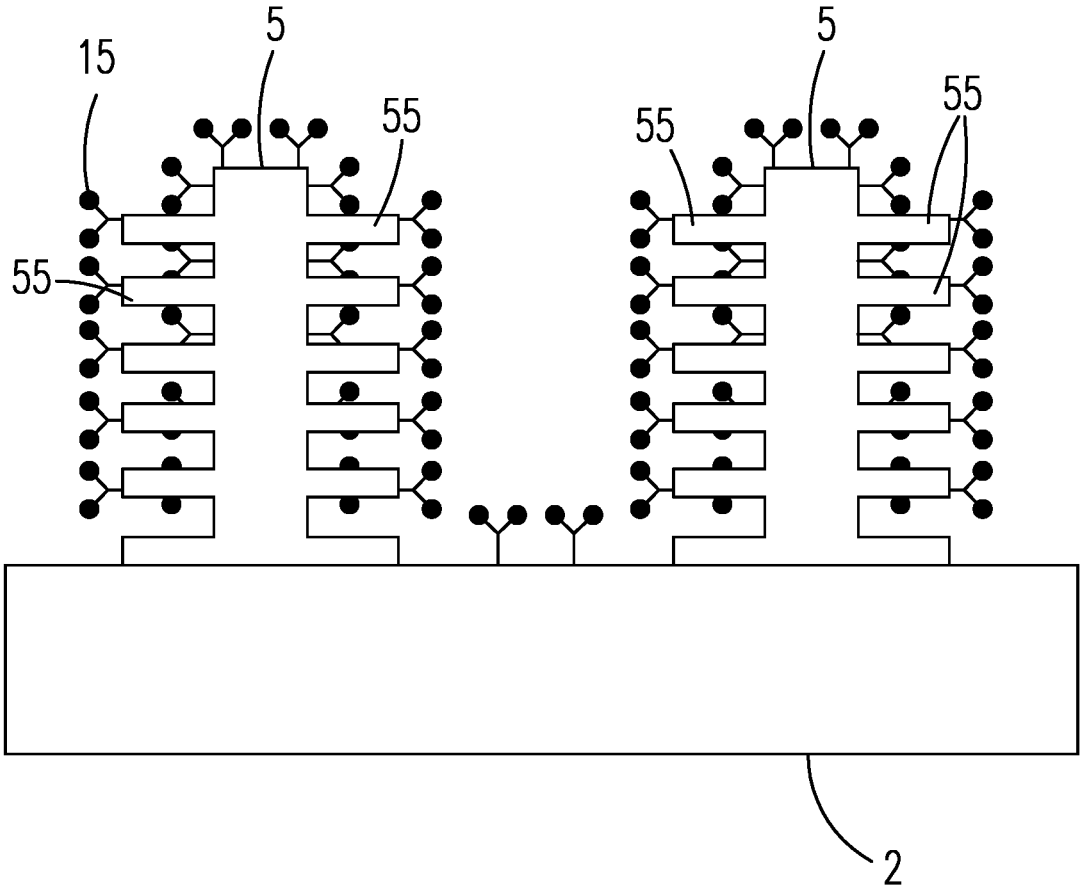
FIG. 7 is a diagram showing that the protrusions have branches in the embodiment of the present invention.

Please refer to FIG. 7, which is a diagram showing that the protrusions 5 have branches 55 in the embodiment of the present invention. As compared to FIG. 6, the cylindrical protrusions 5 having a specific height are modified to ones that have extended branches 55. Branches 55 will be beneficial for bonding more first molecules 15, and thus more second molecules 16 in the droplets can be caught to enhance the reaction sensitivity. It is obvious for the skilled person in the art to modify the protrusion structures in view of the branched protrusions 5 in FIG. 7, or modify the protrusions as the holes with depth so as to achieve the effect of increasing the surface area.

Figure 8:
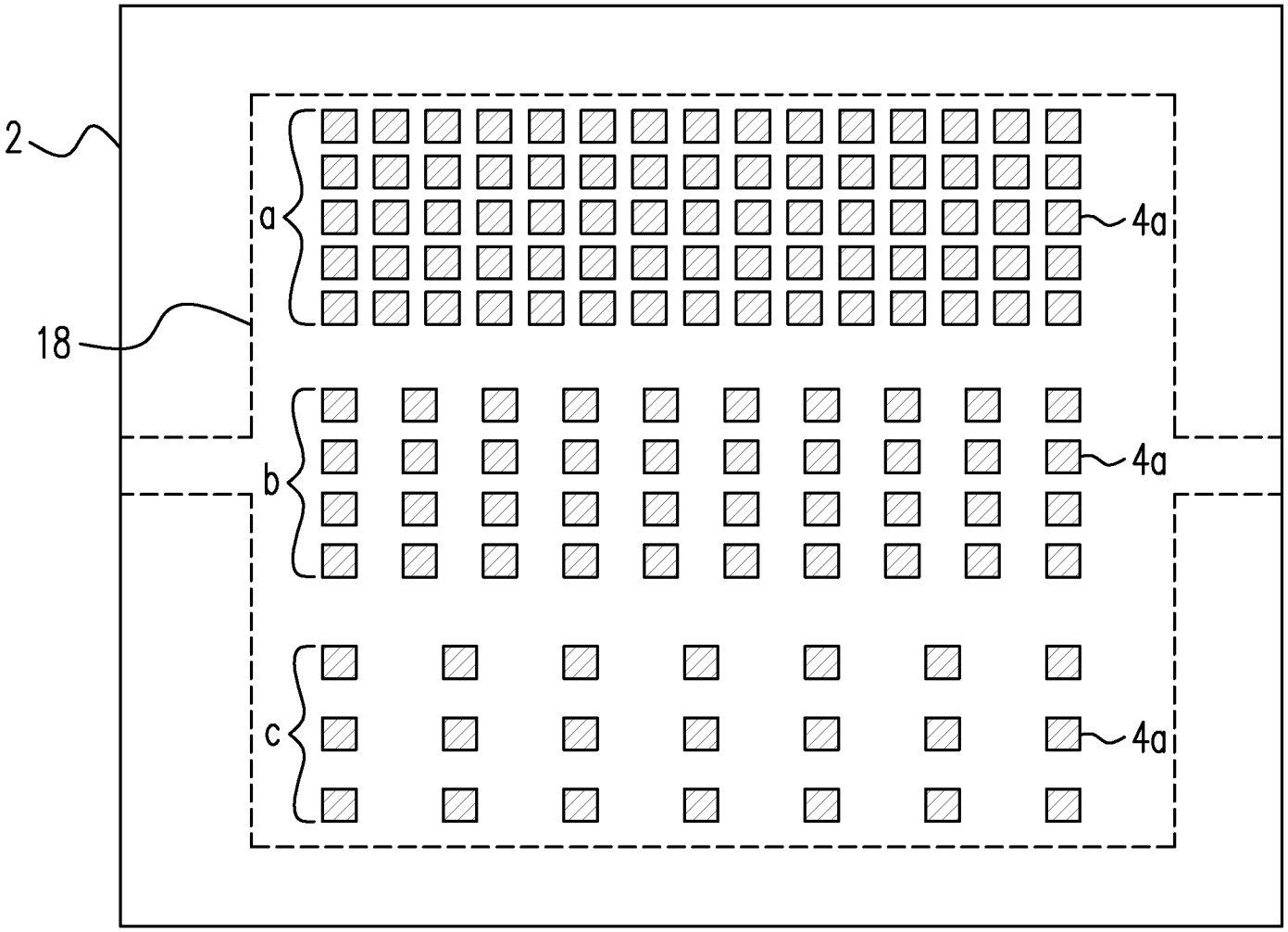
FIG. 8 is a diagram showing that different densities of the SRO units are disposed on the quasi-volumetric device in the embodiment of the present invention.

Various species of SRO units can be configured on the same quasi-volumetric device using the photolithography process technique, and each SRO unit is arranged as an LRO unit by way of specific number and array. Furthermore, the specific first molecules are connected to the protrusions and the surface of the SRO unit, and a subject's blood, serum, urea or other components in the body fluid or the components in one liquid material is detected. Please refer to FIG. 8, which is a diagram showing that different densities of the SRO units are disposed on the quasi-volumetric device in the embodiment of the present invention. In FIG. 8, SRO units 4*a* are disposed on zones a, b and c of the same carrier 2, the SRO units 4*a* are arranged as LRO units by way of specific number and array, and antibodies specific to molecules "X" are connected to the protrusions and the surface of the SRO units. When the subject's blood, plasma or serum spreads on the carrier, and the volume of the sample on the SRO units 4*a* are controlled by the quasi-volumetric method, the signal detection unit detects the signal intensity of the antibodies on the protrusions against the molecules "X", so as to calculate the level of molecules "X" in the serum. The results show that zone "a" has a better detection result against the low level of the molecules "X", zone "c" has a better detection result against the high level of the molecules "X", and the result for zone "b" is for the middle level. It is known from the example in FIG. 8 that the present invention can incorporate signals from zones "a", "b" and "c" (and/or from various number of SRO units and the zones formed by specific arrays) to obtain the wider dynamic range of specific molecules in one sample.

Alternatively, on another carrier 2, the antibodies specific to molecules A, B and C (with the level in the blood being A<B<C) respectively are connected to the protrusions of the SRO units in zones "a", "b" and "c". As mentioned above, signal detection unit detects the signal intensity of the antibodies against the molecules A, B and C so as to calculate the level of the molecules A, B and C in the serum.

After the antibodies on the quasi-volumetric device are bonded with the molecules in the liquid sample, other biochemical reactions can be further processed, such as enzyme-linked immunosorbent assay (ELISA).

Figure 9:
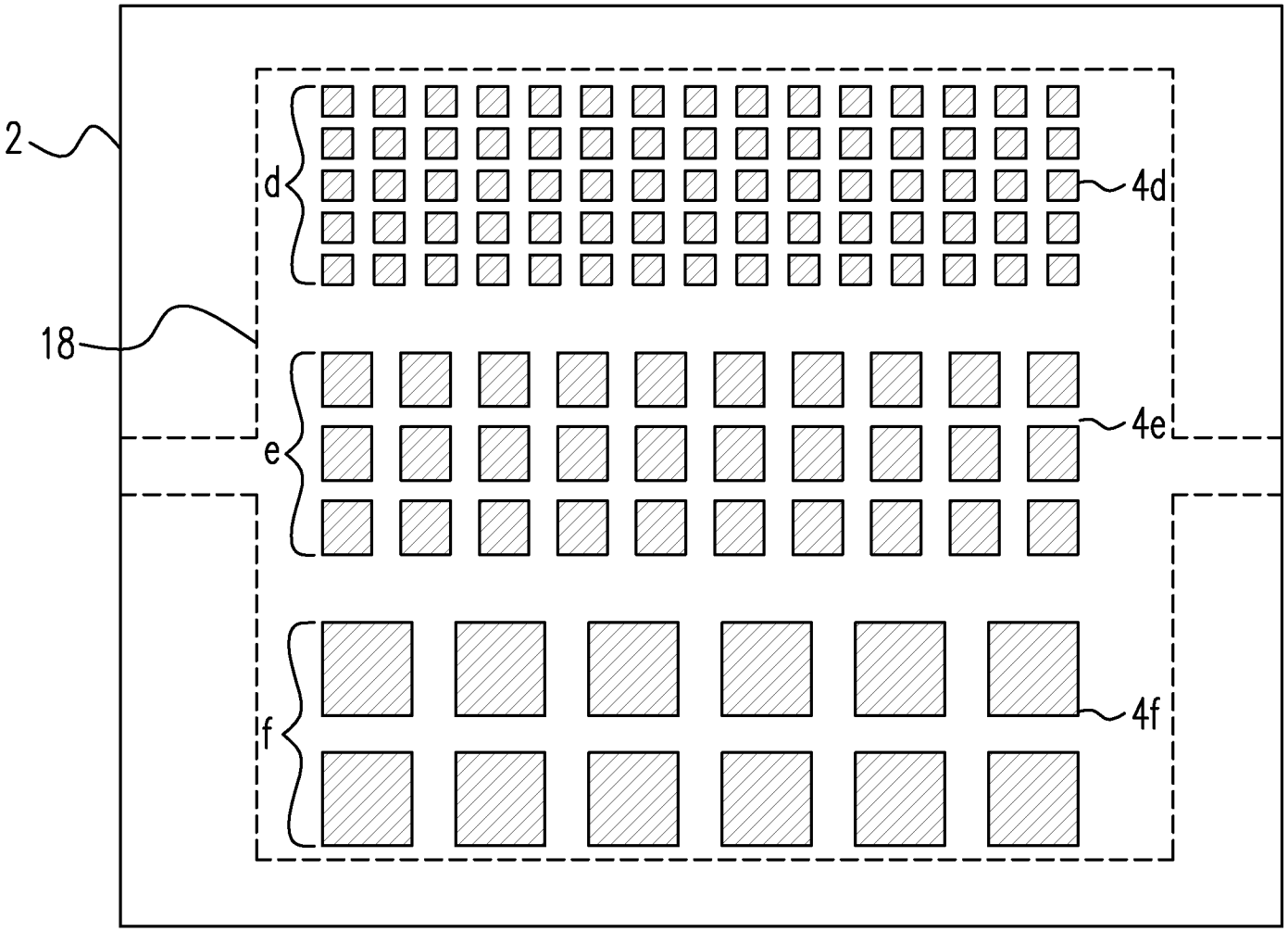
FIG. 9 is a diagram showing that different sizes and densities of the protrusions of the SRO unit are disposed on the quasi-volumetric device in the embodiment of the present invention.

Please refer to FIG. 9, which is a diagram showing that different sizes and densities of the protrusions of the SRO unit is disposed on the quasi-volumetric device in the embodiment of the present invention. In FIG. 9, SRO units 4*d*, 4*e* and 4*f* with different sizes and different densities of protrusions are configured on zones d, e, and f of the carrier 2 respectively, and the relationship between any two SRO units are amplification and minimization. The difference is the number of SRO units and their array patterns. When the SRO units for detecting specific molecules in the liquid sample are designed by the designer using the photolithography process technique, the optimized quasi-volumetric chip, device or system can be manufactured by the design on different sizes, densities of protrusion, numbers and array patterns.

The single quasi-volumetric device having different sizes and densities of protrusions of SRO units in FIG. 9 also can be designed to detect specific molecules (such as pathogenic factors) in a subject's body fluid so as to determine the subject's physiological conditions and stages of disease. Because the number of antibodies coupled on the protrusions of the SRO units 4*d*, 4*e* and 4*f* per surface area are various, different signal intensities that antibodies are coupled to pathogenic factors are determined via the SRO units 4*d*, 4*e* and 4*f* so as to determine whether the subject is determined as illness or health by measuring the level of specific molecules in the subject.

Figure 10A:
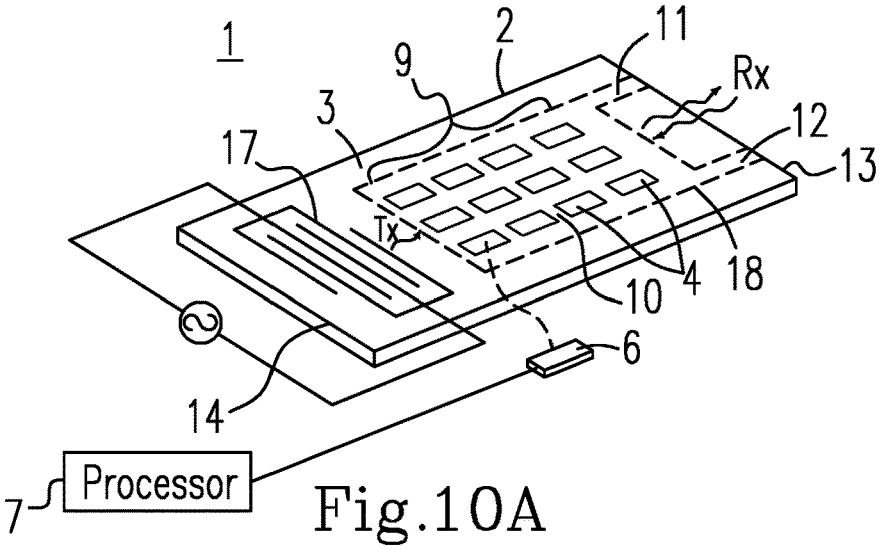
FIG. 10A is a diagram showing a quasi-volumetric device without any liquid sample thereon in the embodiment of the present invention.
Figure 10B:
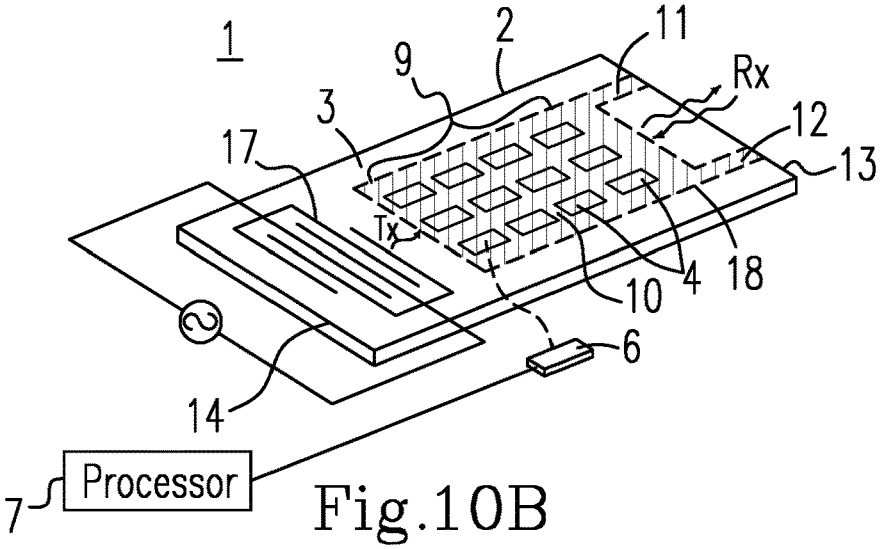
FIG. 10B is a diagram showing a quasi-volumetric device with a liquid sample thereon in the embodiment of the present invention.
Figure 10C:
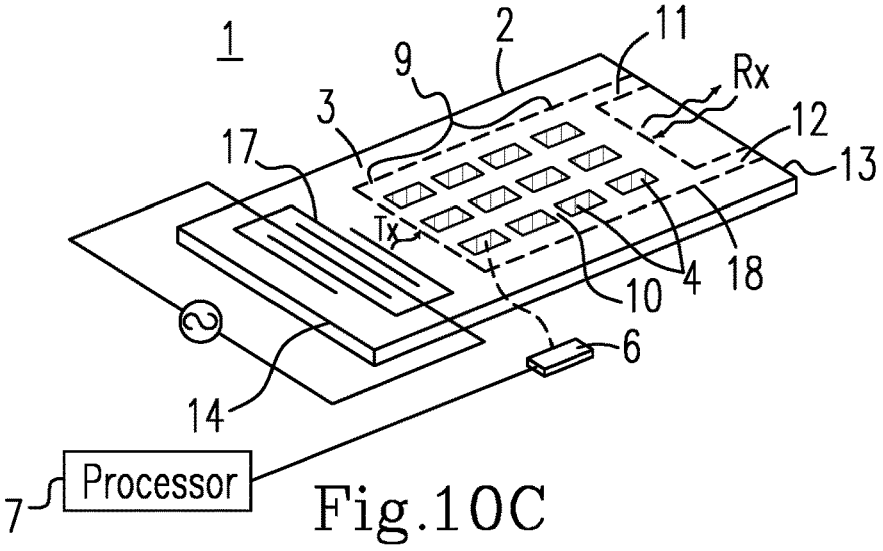
FIG. 10C is a diagram showing that droplets remain on the SRO units of the quasi-volumetric device in the embodiment of the present invention.

In one embodiment of the present invention, the liquid sample enters into the quasi-volumetric device through the inlet and leaves from the outlet, and droplets are retained on the SRO units. Please refer to FIGS. 10A to 10C, wherein FIG. 10A is the quasi-volumetric device 1 in FIG. 1A. When the liquid sample enters into the inlet 11 of the quasi-volumetric device 1, the liquid sample can exist in all (i.e. the slash zone in FIG. 10B) or a part of reaction zone 18. Next, the redundant liquid sample leaves the reaction zone 18 from the outlet 12, and the remaining droplets exist on the SRO units 4 (i.e. the slash regions on FIG. 10C). Thus, the level of specific molecules in the liquid sample or droplets and/or the volume of droplets existing on the SRO units are calculated.

In conclusion:

In the system, device and method disclosed in the present invention, the configuration of the inlet and the outlet are not essential, but the liquid sample can flow to the SRO units via the inlet and automatically distribute to the SRO units. The determination of total volume of the liquid sample or the droplets on the SRO units is called quasi-volumetric quantification. Therefore, the determined electronic or optical signals from all SRO units are added up, and thus variance (tolerance) is decreased and sensitivity is increased.

Because the signals of each SRO units are independently collected by the plural signal detection units, thus the question that the defects in the chip affect the subsequent reading values in the prior art would not occur. If there is only a few defects in a qualified chip device but most SRO units can be normally operated, the measurement for the chip device still is not affected so as to obtain the high reliability of the measurement results.

While the invention has been described in terms of what is presently considered to be the most practical and preferred Embodiments, it is to be understood that the invention need not be limited to the disclosed Embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A device for quantifying a volume to be reacted in a liquid sample, comprising:

a carrier including a surface and a plurality of short-range order (SRO) units disposed on the surface, wherein each of the plurality of SRO units includes a first area and a plurality of arrays of protrusions distributed on the first area, the plurality of arrays of protrusions are configured to contact a droplet having a specific volume and a first parameter, and the droplet originates from the liquid sample;

a plurality of signal detection units, each of which is configured to detect the respective first parameter; and a processor coupled to the plurality of signal detection units and configured to calculate the volume to be reacted according to the first parameter and a formula (I) as follows:

$$V = \sum_{i=1}^{n} Vi(\theta, a), \quad \text{(I)}$$

where V is the volume to be reacted, Vi is the specific volume, θ is a contact angle formed between the droplet and the surface, a is an area within the first area, and n is the number of the plurality of SRO units.

2. The device according to claim 1, wherein there is a hydrophobic surface between any adjacent two of the SRO units within the surface.

3. The device according to claim 2, wherein the plurality of SRO units are arranged to form an array on the surface, and the array is a long-range order (LRO) unit having a first end and a second end to form a path between the first end and the second end.

4. The device according to claim 3, wherein the droplet on the carrier is driven by a force, and moves from the first end to the second end so as to remove a redundant liquid from the droplet.

5. The device according to claim 2, wherein the device further comprises an inlet and an outlet, and the inlet and the outlet are configured at the same end or at two different ends of the carrier.

6. The device according to claim 2, further comprising a plurality of first specific molecules having a first part thereof being configured on the protrusions, wherein the droplet includes a plurality of second molecules, to and with which the plurality of first molecules are respectively specific and coupled.

7. The device according to claim 6, wherein each of the plurality of signal detection units is further configured to detect signals generated when the plurality of first molecules are coupled with the plurality of second molecules, at least one of the protrusions has branches thereon, and the plurality of first specific molecules are configured on the branches.

8. The device according to claim 7, wherein the processor is further configured to calculate a second parameter of the plurality of second molecules in the liquid sample according to the signals, and the second parameter is at least one selected from the group consisting of the concentration of the second molecules, the number of the second molecules and the viscosity of the droplet.

9. The device according to claim 6, wherein the plurality of first molecules have a second part thereof configured on the surface.

10. A method for quantifying a volume to be reacted in a liquid sample by a chip, wherein the chip comprises a carrier, a plurality of short-range order (SRO) units on the carrier, and a plurality of signal detection units electrically connected to each of the plurality of SRO units, and each of the plurality of SRO units includes a plurality of arrays of protrusions being distributed thereon, the method comprising:

providing the liquid sample;

applying the liquid sample on the carrier to enable the plurality of arrays of protrusions to contact a droplet having a specific volume and a first parameter, wherein the droplet originates from the liquid sample;

detecting the first parameter with a respective one of the plurality of signal detection units; and calculating the volume to be reacted according to the first parameter and a formula (I) as follows:

$$V = \sum_{i=1}^{n} Vi(\theta, a), \quad \text{(I)}$$

where V is the volume to be reacted, Vi is the specific volume, θ is a contact angle formed between the droplet and the surface, a is an area within the first area, and n is the number of the plurality of SRO units.

11. The method according to claim 10, wherein there is a hydrophobic surface between any adjacent two of the SRO units within the surface, the plurality of SRO units are arranged to form an array on the surface, and the array is a long-range order (LRO) unit having a first end and a second end to form a path between the first end and the second end.

12. The method according to claim 11, further comprising:

applying a force on the droplet to enable the droplet to move from the first end to the second end so as to remove a redundant liquid from the droplet.

13. The method according to claim 12, wherein the force is one selected from the group consisting of mechanical force, electromagnetic force, capillary force, hydrophilicity, hydrophobicity, gradient of hydrophilicity and the combination thereof.

14. The method according to claim 13, wherein the mechanical force is one of gravity and waves generated from the piezoelectric effect.

15. A quasi-volumetric sensing system for a liquid sample, comprising:

a carrier including a surface; and a plurality of short-range order (SRO) units configured on the surface, wherein each of the plurality of SRO units includes a plurality of areas each of which includes a plurality of arrays of protrusions, and a distance between any adjacent two protrusions in one area is different from that in another area, wherein the liquid sample is applied to run across the plurality of SRO units to enable at least one droplet from the liquid sample to be retained on at least one of the plurality of arrays of protrusions.

16. The quasi-volumetric sensing system according to claim 15, wherein the at least one droplet includes a first parameter and a specific volume, the liquid sample includes a plurality of molecules having a specific concentration, and the quasi-volumetric sensing system further comprises:

a plurality of signal detection units, each of which is electrically connected to a respective one of the plurality of SRO units to detect the respective first parameter; and a processor coupled to the plurality of signal detection units and configured to calculate the specific concentration according to the first parameter, wherein the sum of all of the specific volumes is a volume to be reacted, the specific volumes are determined by a structure of the plurality of SRO units, and the volume to be reacted is obtained according to a formula (I) as follows:

$$V = \sum_{i=1}^{n} Vi(\theta, a), \tag{I}$$

where V is the volume to be reacted, Vi is the specific volume, θ is a contact angle formed between the droplet and the surface, a is an area within the first area, and n is the number of the plurality of SRO units.

* * * * *